US005839045A

United States Patent [19]

Wierszewski

[11] Patent Number: 5,839,045

[45] Date of Patent: Nov. 17, 1998

[54] METHOD AND APPARATUS FOR INSERTING SHEETS INTO A STREAM OF SHEETS IN A SPACED APART RELATIONSHIP

[75] Inventor: Ronald R. Wierszewski, Henrietta, N.Y.

[73] Assignee: Xerox Corporation, Stamford, Conn.

[21] Appl. No.: 904,013

[22] Filed: Jul. 31, 1997

[51] Int. Cl.[6] ..... G03G 21/00

[52] U.S. Cl. ..... 399/382; 399/397

[58] Field of Search ..... 399/382, 43, 397, 399/407; 346/134; 270/58.31, 58.32

[56] References Cited

U.S. PATENT DOCUMENTS

| | | | |
|---|---|---|---|
| 3,564,960 | 2/1971 | Foulks | 83/203 |
| 4,427,287 | 1/1984 | Matsumoto et al. | 355/14 SH |
| 4,579,444 | 4/1986 | Pinckney et al. | 355/14 SH |
| 4,785,325 | 11/1988 | Kramer et al. | 355/8 |
| 4,892,426 | 1/1990 | Steele | 400/708 |
| 5,130,750 | 7/1992 | Rabb | 399/364 |
| 5,272,511 | 12/1993 | Conrad et al. | 399/382 |
| 5,339,139 | 8/1994 | Fullerton et al. | 355/215 |
| 5,423,527 | 6/1995 | Tranquilla | 271/10 |
| 5,457,524 | 10/1995 | Metcalf et al. | 399/382 |
| 5,461,468 | 10/1995 | Dempsey et al. | 355/316 |
| 5,489,969 | 2/1996 | Soler et al. | 355/207 |
| 5,559,595 | 9/1996 | Farrell | 355/325 |
| 5,596,389 | 1/1997 | Dumas et al. | 399/16 |
| 5,715,514 | 2/1998 | Williams et al. | 399/395 |

FOREIGN PATENT DOCUMENTS

| | | |
|---|---|---|
| 5-286606 | 11/1993 | Japan . |
| 8-272164 | 10/1996 | Japan . |

*Primary Examiner*—Arthur T. Grimley
*Assistant Examiner*—Quana Grainger
*Attorney, Agent, or Firm*—John S. Wagley

[57] ABSTRACT

A method for synchronizing the feeding of an insert by a first drive mechanism with a sheet feed by a second feed mechanism and the first feed mechanism is disclosed. The method includes the steps of placing the sheet in operable contact with the second feed mechanism at a first position, traversing the sheet sequentially with the second feed mechanism and the first feed mechanism, advancing the sheet toward a second position in cooperation with a first sensor adjacent one of the first feed mechanism and the second feed mechanism, placing the insert in operable contact with the first feed mechanism at a third position subsequent to the first sheet being in cooperation with the sensor, and advancing the insert into a fourth position within the first feed mechanism positioned closely behind the sheet positioned at a fifth position within the first feed mechanism.

6 Claims, 7 Drawing Sheets

METHOD AND APPARATUS FOR INSERTING SHEETS INTO A STREAM OF SHEETS IN A SPACED APART RELATIONSHIP

The present invention relates to feeding substrates through an electrophotographic printing machine. More particularly, the invention relates to adding preprinted substrates to a set of printed sheets.

Cross reference is made to the following application filed concurrently herewith: U.S. patent application Ser. No. 08/903,808 entitled "Synchronized Paper Feeding Across Module Boundaries With Timed Clock Ticks" by Ronald R. Wierszewski.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8½×11, or 8½×14 inch copy sheets. These machines may be of the light lens, xerographic machine or may be a printer with digital input. Single, cut sheet printing machines are now available at speeds around 200 cpm.

The new high speed printing machines typically include a plurality of paper trays for storing copy substrate for use in the printing machine. These trays hold a sizable amount of sheets, for example, from 200 to 1,000 sheets per tray. As such, with 2,000 sheet storage capacity within the trays of the machine, the trays may be depleted within ten minutes. Further, the number of trays may be limited to three or less allowing the immediate availability of only three different types of copy sheets. Therefore, there is a need for additional copy sheet capacity as well as for availability of more different types of copy sheets within the printing machine.

One answer to the problem with providing enough quantity and variety of copy sheets for a copy machine is the use of an interposer. An interposer is a sheet feeding section for a printing system that may be interposed or placed between the printing engine of the printing system and the output tray or finisher of the printing system. The interposer includes additional paper trays to provide additional copy sheet capacity as well as additional options for copy sheet type to be stored within the machine.

The primary output product for a typical electrostatographic printing system is a printed copy substrate such as a sheet of paper bearing printed information in a specified format. Quite often, customer requirements necessitate that this output product be configured in various specialized arrangements or in print sets ranging from stacks of collated loose printed sheets to tabulated and bound booklets.

For example, it is not uncommon to place specially colored sheets, chapter dividers, photographs or other special insert sheets into a print set to product a final document. For example, it is common to use preprinted sheets which were produced by four-color offset press techniques as special insert sheets in a document containing mostly text printed on ordinary white paper. In another example, booklets produced from signatures, often use special cover sheets or center sheets containing, for example, coupons. It is generally not desirable to pass these sheets through the printer processing apparatus because the ink on the special insert sheets tends to be smudged by the paper-handling rollers, etc. of the document producing apparatus. In addition, these special insert sheets may be of a particular weight stock or may include protruding tabs which may cause jams when transported through the printer processor.

In that the requirements for customers vary for high speed printing machines, interposers as described above are typically optional additions to the printing machines. Therefore, printing engines and finishers are designed to be separable from each other and an interposer optionally connected therebetween. The interposer thus is preferably a separable, completely independent unit that may be added with the machine as installed or as an upgrade later. The printing machine is therefore typically driven by a mechanism separate and independent from the driver for the interposer. However, sheets from the interposer must interact, cooperate and coordinate with sheets from the printing engine. Sheets that begin in the interposer may enter into the printing engine and back across the interposer to the finisher. Likewise, sheets may begin in the interposer and meet with sheets in the printing engine in the interposer to form sets of sheets in the finisher. Therefore, it is important that the sheets within an interposer and sheets within a printer be tracked and coordinated through both modules.

To allow for the inserting of preprinted sheets into a stream of printed sheets from a print engine, copy machines typically have what is know as a "skip" pitch. A skip pitch is a missing sheet or a plurality of missing sheets within the stream of copy paper through the printer. The use of a skip pitch or skip pitches permits the addition of inserts into a finisher.

Accordingly, these special insert sheets must be inserted into the stream of sheets subsequent to processing in the printer processor section of the document producing apparatus. It is desirable to insert these sheets without disrupting the flow of the continuous stream of processed sheets. It is also desirable to insert these sheets in a manner which is transparent to the print processor on the finishing apparatus so that the operation of these apparatus need not be modified.

Preferably, the interposer has a modular construction or nature so that the interposer may be optionally added between the print module and the finishing module. By the module construction, a printing machine may be available with or without the interposer depending on need and may be added to the machine subsequent to its original sale if the needs of the customer change. Because of the modular nature of the interposer, there is poor coupling or communication between the interposer and the printing machine.

Typically, because of the modular nature of the interposer, the inserts within the interposer are driven by a first feed mechanism while the sheets within the print engine are driven by a second and different feed mechanism. Each of the respective feed mechanisms has its own separate motor. The use of multiple motors to drive the sheets and the inserts makes synchronizing the feeding of the sheets and the inserts very difficult. This problem is compounded by the fact that the sheets within the print engine may travel different paths and have inconsistent sheet feeding times within the print engine. For example, the sheets may or may not be duplexed or copied on both sides. An inverter within the printing machine may optionally invert the sheets and cause the sheet to be fed to the print engines again varying the time for feeding of the sheets.

When sheets that originated one module driven by the motor for that module and are later transported to a second module where a second motor drives the sheets, the synchronizing of the sheets within the machine is much more difficult. Further, the sequencing of inserts and sheets to make a set or booklet of sheets varies from job to job compounding this problem. For example, the sheet may first be fed and followed later by an insert. Alternatively, an insert may be the first sheet in the set of sheets. Thirdly, an insert may follow a previous insert. Each of these three alternatives creates its own unique timing problem.

The synchronized insert feeder of the present invention is intended to alleviate at least some of the problems heretofore mentioned.

The following disclosures relate to the area of inserting one or more insert sheets among a plurality of previously marked sheets:

U.S. Pat. No. 5,596,389
Patentee: Dumas et al.
Issued: Jan. 21, 1997

U.S. Pat. No. 5,559,595
Patentee: Farrell
Issued: Sep. 24, 1996

U.S. Pat. No. 5,489,969
Patentee: Soler et al.
Issued: Feb. 6, 1996

U.S. Pat. No. 5,461,468
Patentee: Dempsey et al.
Issued: Oct. 24, 1995

U.S. Pat. No. 5,423,527
Patentee: Tranquilla
Issued: Jun. 13, 1995

U.S. Pat. No. 5,339,139
Patentee: Fullerton et al.
Issued: Aug. 16, 1994

U.S. Pat. No. 4,892,426
Patentee: Steele
Issued: Jan. 9, 1990

U.S. Pat. No. 4,785,325
Patentee: Kramer et al.
Issued: Nov. 15, 1988

U.S. Pat. No. 4,579,444
Patentee: Pinckney et al.
Issued: Apr. 1, 1986

U.S. Pat. No. 4,427,287
Patentee: Matsumoto et al.
Issued: Jan. 24, 1984

U.S. Pat. No. 3,564,960
Patentee: Foulks
Issued: Feb. 23, 1971

The relevant portions of the foregoing disclosures may be briefly summarized as follows:

U.S. Pat. No. 5,596,389 discloses a scheduling apparatus for a printing system. The scheduling apparatus includes a memory for storing a set of two or more feed signals. The set of feed signals includes a first feed signal and a second feed signal with the first feed signal and the second feed signal corresponding respectively with a special sheet and an imagable regular substrate having opposing sides. The scheduling apparatus further includes a controller for generating the first and second feed signals. The controller which communicates with each of a print engine and a special sheet insertion apparatus determines whether the imagable regular substrate is to be imaged on both of the opposing sides and, when it is determined that the imagable regular substrate is to be imaged on both the opposing sides, the controller schedules the first and second feed signals to be transmitted respectively to the print engine and the special sheet insert apparatus during a single pitch.

U.S. Pat. No. 5,559,595 discloses a special sheet handling apparatus for use with a printing system. The printing system includes a print engine. The special sheet handling apparatus includes a special sheet insertion path operatively coupled with the print engine. Substrates, each having a stock orientation and being imaged with the print engine, are delivered to the special sheet insertion path as output, while a special sheet, having a special sheet orientation, when disposed in the special sheet insertion path, is added to the output by the special sheet handling orientation. A processor determines whether the stock orientation is the same as the special sheet orientation. When the orientations are different, and the special sheet is invertable, the special sheet is inverted at an inverting station communication with the special sheet insertion path.

U.S. Pat. No. 5,489,969 discloses a technique for controlling the interposition of one or more special sheets into a stream of regular imaged substrates. In one example, a point in time at which a special insert sheet should be fed from a special insertion sheet subsystem to the stream is determined by reference to plural sheets of preset time periods. In this example, the preset time periods can be adjusted to accommodate print engine/interposing module machine clock fluctuations. In another example, interposition of a special inserter sheet with the stream of regular imaged substrates is maintained at an acceptable level by comparing a distance between a special insert sheet fed to the stream and an adjacent regular imaged substrate with a predefined tolerance. The comparison can then be used to adjust feed times of special insert sheets subsequently fed to the stream.

U.S. Pat. No. 5,461,468 discloses a document handler interdocument gap control system. A first servo drive feeds document in a first path portion and a second servo drive feeds documents in the second path portion. A sheet edge sensor in the first path portion signal the passage of the lead or trail edge of document sheets.

U.S. Pat. No. 5,423,527 discloses a method of processing documents by moving them from an input hopper to a destination site at a controlled rate. The method includes driving each document into a feed path from the input hopper at an adjustable time period after a previous document has been feed, then sensing the distance separating the documents and adjusting the time period between driving of succeeding documents to achieve a desired gap.

U.S. Pat. No. 4,892,426 discloses a paper movement monitor for monitoring the movement of paper through a printer. The monitor includes sensors in the form of photo-optical wheels which are in rolling contact with the paper and sense the position of the paper.

U.S. Pat. No. 4,785,325 discloses a document imaging system including a mechanism for adjusting the speed ratio between the document scanning system and the photoreceptor. A timing belt is connected between an adjustable tapered portion of a drive pulley mounted on the photoreceptor drive shaft and the document scanning system. The portion of the tapered surface on which the belt is driven is axially adjustable resting in a change in scanning speed.

U.S. Pat. No. 4,579,444 discloses a document registration system for use in a document feeder of a copier. the registration system includes a control system for controlling document platen transport to stop at a desired calculated position. The system includes a sensor and upstream of the trailing edge of a document. The sensor provides a signal indicative of the size of the copy sheet and calculates a stopping position on the platen based on the selected copy reduction size.

U.S. Pat. No. 4,427,287 discloses a copying machine having an automatic document feeder. The copy machine has a single motor for driving a drive mechanism for the main body and a drive mechanism for the automatic document feeder. A timing disk is coupled to the motor for supplying a timing signal. Based on this signal, a CPU controls the operation of the copy machine.

U.S. Pat. No. 3,564,960 discloses a copy machine copy paper length error compensating system. As an original moves forward, a trailing edge sensor sends; an initial cutting signal to a super-precise electronic timer having a capacitor. The charging interval of the capacitor is controlled to maintain cut length of the sheet.

As will be seen from an examination of the cited prior art, it is desirable to provide an electrostatographic copying machine with the ability to have a printing engine trays and an auxiliary paper trays and to coordinate and time the travel of the sheets from the two types of trays. The inaccuracies and differences between the driving of the copy sheets within the interposer or auxiliary copy section and the print engine results in misfeeding of sheets and inserts and possible paper jams. This invention is directed to improving the accuracy of the insertion of inserts from a printing tray into a stream of copy sheets.

In accordance with one aspect of the invention, there is provided a method for synchronizing the feeding of an insert by a first drive mechanism with a sheet feed by a second feed mechanism and the first feed mechanism. The method includes the steps of placing the sheet in operable contact with the second feed mechanism at a first position, traversing the sheet sequentially with the second feed mechanism and the first feed mechanism, advancing the sheet toward a second position in cooperation with a first sensor adjacent one of the first feed mechanism and the second feed mechanism, placing the insert in operable contact with the first feed mechanism at a third position subsequent to the first sheet being in cooperation with the sensor, and advancing the insert into a fourth position within the first feed mechanism positioned closely behind the sheet positioned at a fifth position within the first feed mechanism.

In accordance with another aspect of the present invention, there is provided a printing apparatus for synchronizing the sequential arrival of a sheet and an insert at an insertion location. The printing apparatus includes a first feed mechanism operably associated with the printing apparatus for translating the insert from a third position within the first feed mechanism. The printing apparatus also includes a second feed mechanism operably associated with the printing apparatus for translating the sheet from a first position within the second feed mechanism to the first feed mechanism. The first feed mechanism is adapted to translate the sheet from the second feed mechanism. The printing apparatus also includes an engager connected to the first feed mechanism for engaging and disengaging the first feed mechanism from the insert at the third position. The printing apparatus also includes a first sensor operably associated with the printing apparatus and positioned at a first sensor location adjacent a second position within one of the first feed mechanism and the second feed mechanism for determining when the sheet approaches the second position. The printing apparatus also includes a controller operably associated with the first sensor and the engaging means for receiving input from the first sensor and sending a signal to the engaging means to release the engaging means such that the insert arrives at a fourth position within the first feed mechanism, downstream from the third position and such that the sheet arrives at a fifth position within the first feed mechanism, downstream from the fourth position. The insert is positioned at the fourth position downstream and adjacent to the sheet.

In accordance with yet another aspect of the present invention, there is provided a method for synchronizing the feeding of a trailing insert by a first drive mechanism immediately subsequent to the feeding of a leading insert by the first feed mechanism into a stream of substantially equally spaced traversing sheets at a insertion location. The stream of sheets is feed from a second feed mechanism. The method includes the steps of placing one of the sheets in operable contact with the second feed mechanism at a sheet feed initiation position at a latent image time related to the transfer of the latent image to the sheet, traversing the sheet sequentially with the second feed mechanism and the first feed mechanism, advancing the sheet toward a sheet sense position in cooperation with a first sensor adjacent one of the first feed mechanism and the second feed mechanism, releasing the first insert from an insert release means at a release time based on the time required for the sheet to travel from the first sensor to an insertion location and the time required for the first insert to travel from an insert release position to the insertion location so that the first insert arrives at the insertion location immediately subsequent to the sheet, calculating a release time for the first insert relative to the latent image time, and releasing a second insert based on the release time of the first insert relative to the latent image time in order that the second insert arrives at the insertion location immediately subsequent to the first insert.

In accordance with yet another aspect of the present invention, there is provided a printing apparatus for synchronizing the feeding of a trailing insert by a first drive mechanism immediately subsequent to the feeding of a leading insert by the first feed mechanism into a stream of substantially equally spaced traversing sheets at a insertion location. The stream is feed by a second feed mechanism. The printing apparatus includes a first feed mechanism operably associated with the printing apparatus for translating the leading insert and the trailing insert. The first feed mechanism defines a insert release position. The printing apparatus includes a second feed mechanism operably associated with the printing apparatus for traversing a sheet at a sheet feed initiation position at a latent image time related to the transfer of the latent image to the sheet. The second feed mechanism urges the sheet toward the first feed mechanism. The first feed mechanism is adapted to translate the sheet from the second feed mechanism. The printing apparatus further includes an engager connected to the first feed mechanism for engaging and disengaging the first feed mechanism from the insert. The printing apparatus further includes a first sensor operably associated with the printing apparatus and positioned at a first sensor location adjacent one of the first feed mechanism and the second feed mechanism for determining when the sheet approaches the first sensor location. The printing apparatus further includes a controller operably associated with the first sensor and the engaging means for receiving input from the sensor, for sending a signal to the engaging means to release a trailing insert based on the release time of the leading insert relative to the pitch reset time in order that the trailing insert arrives at the insertion location immediately subsequent to the leading insert and sending a signal to the engaging means to release the engaging means at such a point in time relative the passing of the sheet pass the sensor such that the sheet and the insert arrive sequentially at the insertion location.

For a general understanding of the present invention, as well as other aspects thereof, reference is made to the following description and drawings, in which like reference numerals are used to refer to like elements, and wherein.

Figure 1:
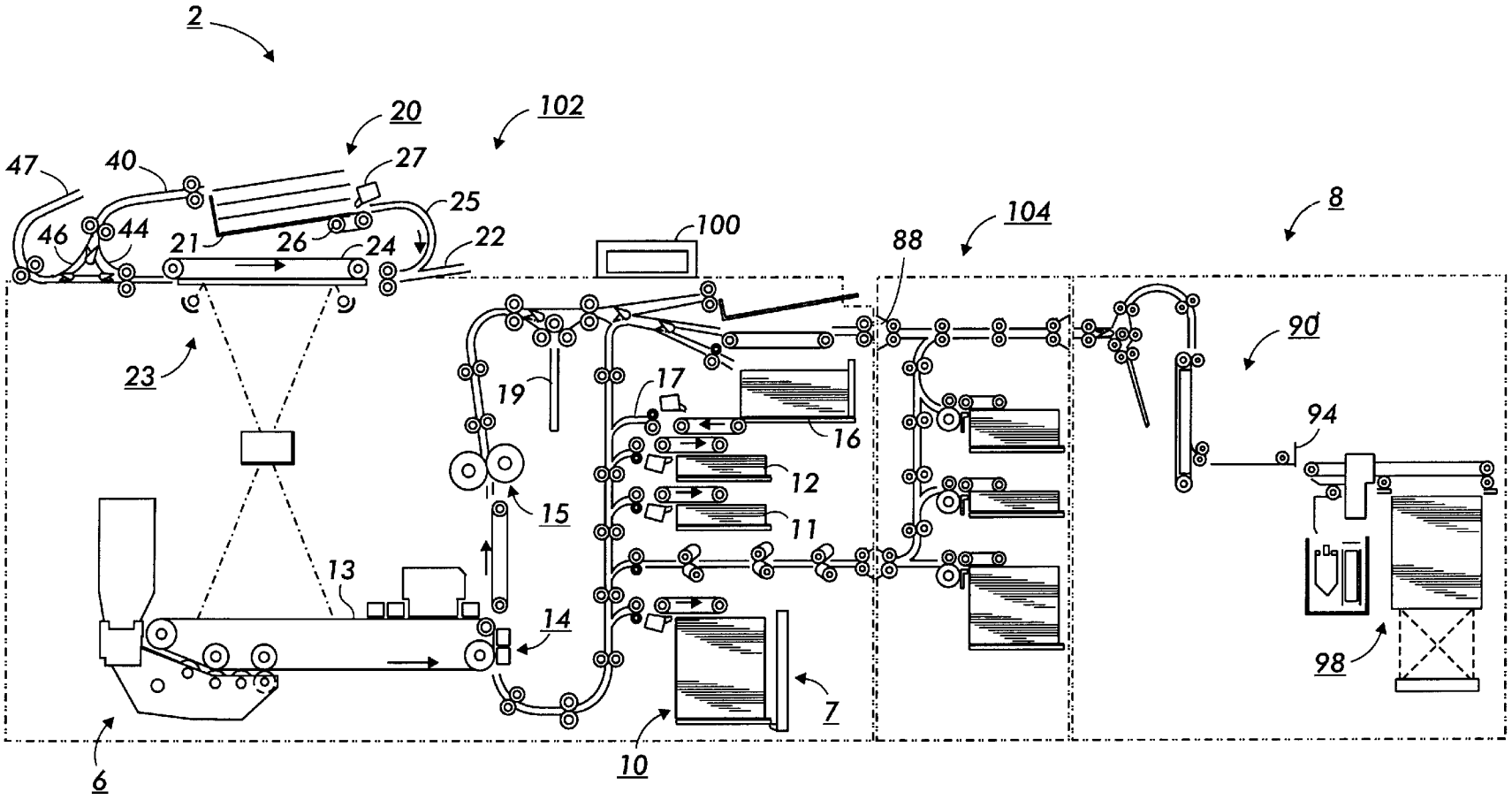
FIG. 1 is a schematic view illustrating the principal mechanical components and paper path of the printing system incorporating the synchronized insert feeder of the present invention.
Figure 4:
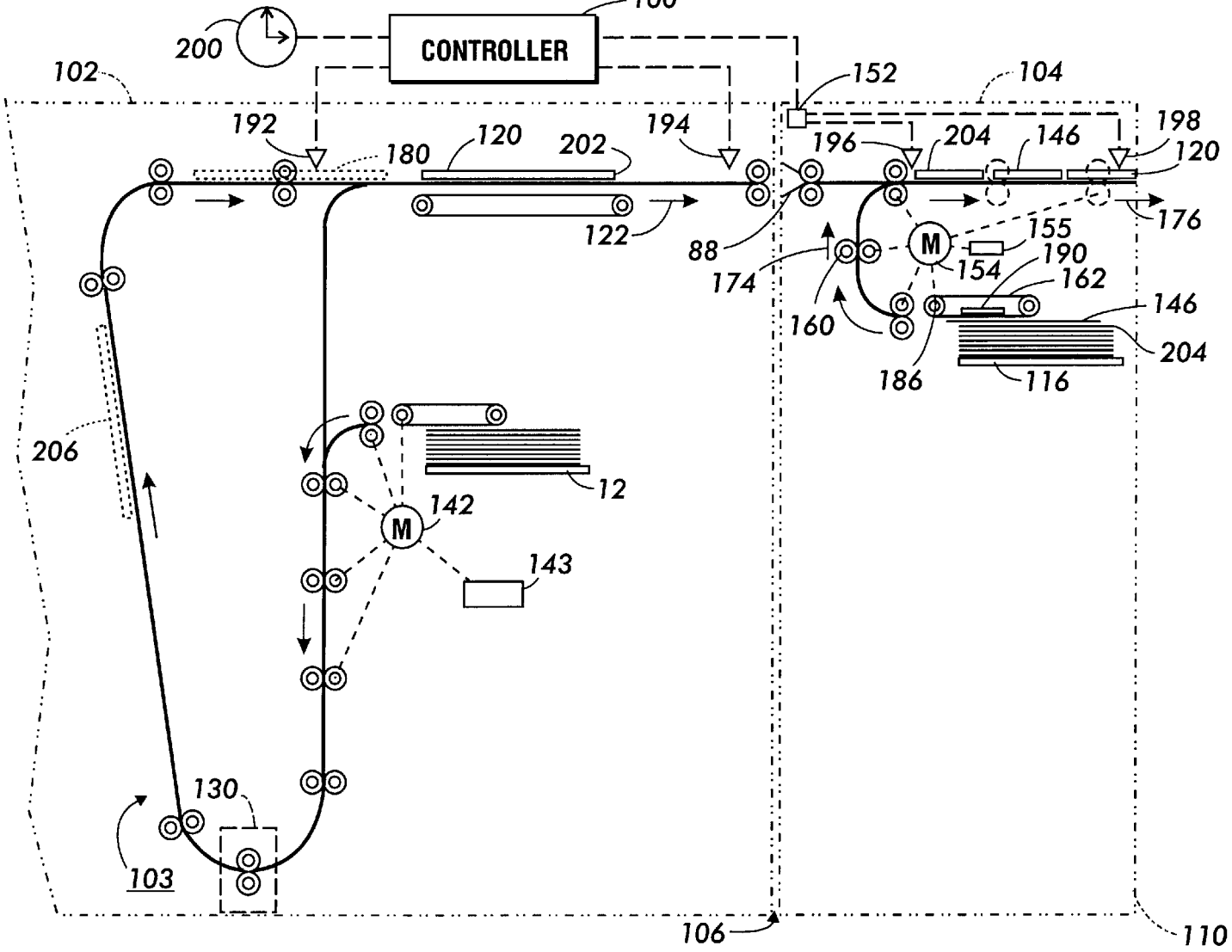
Figure 5:
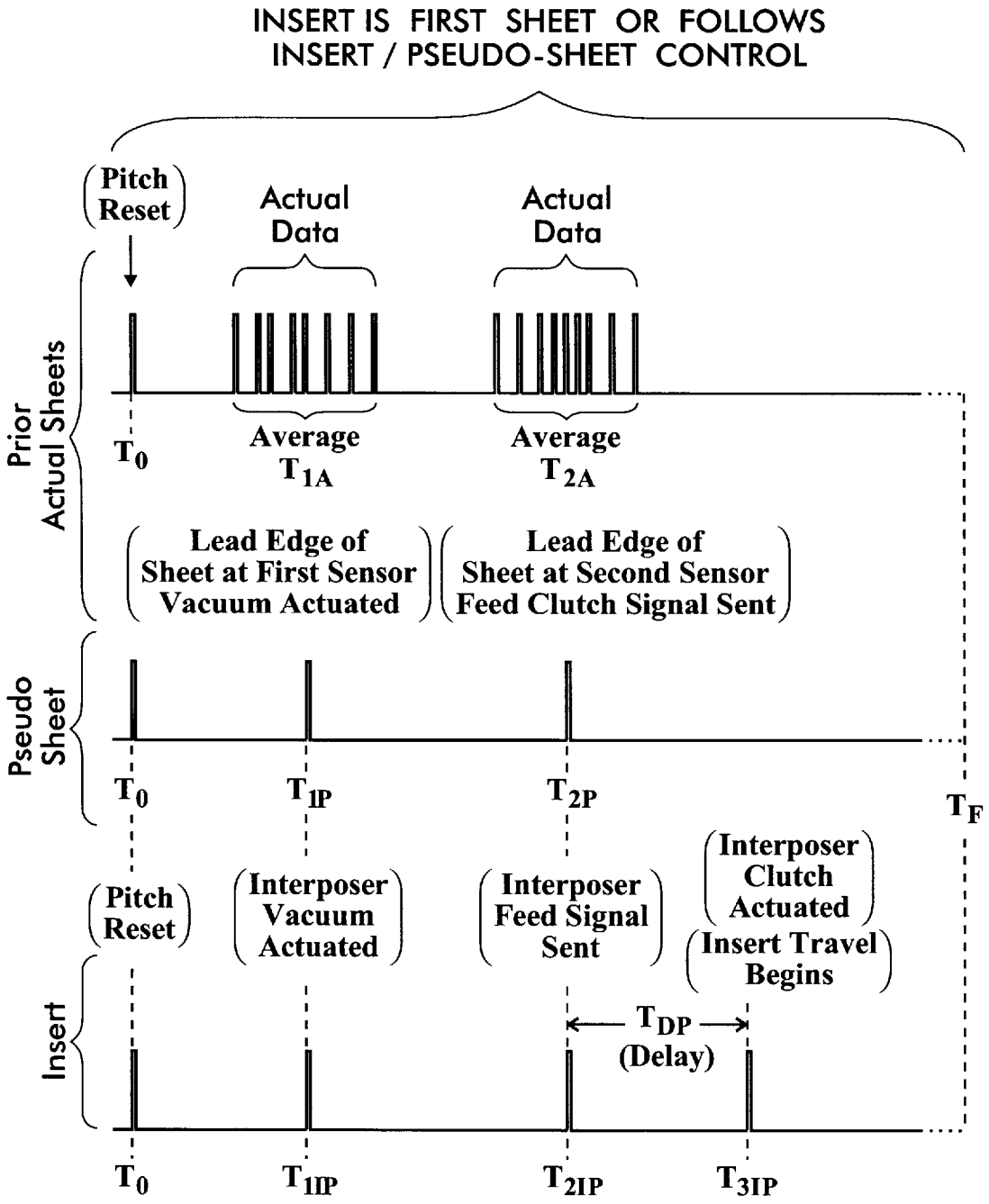
Figure 6:
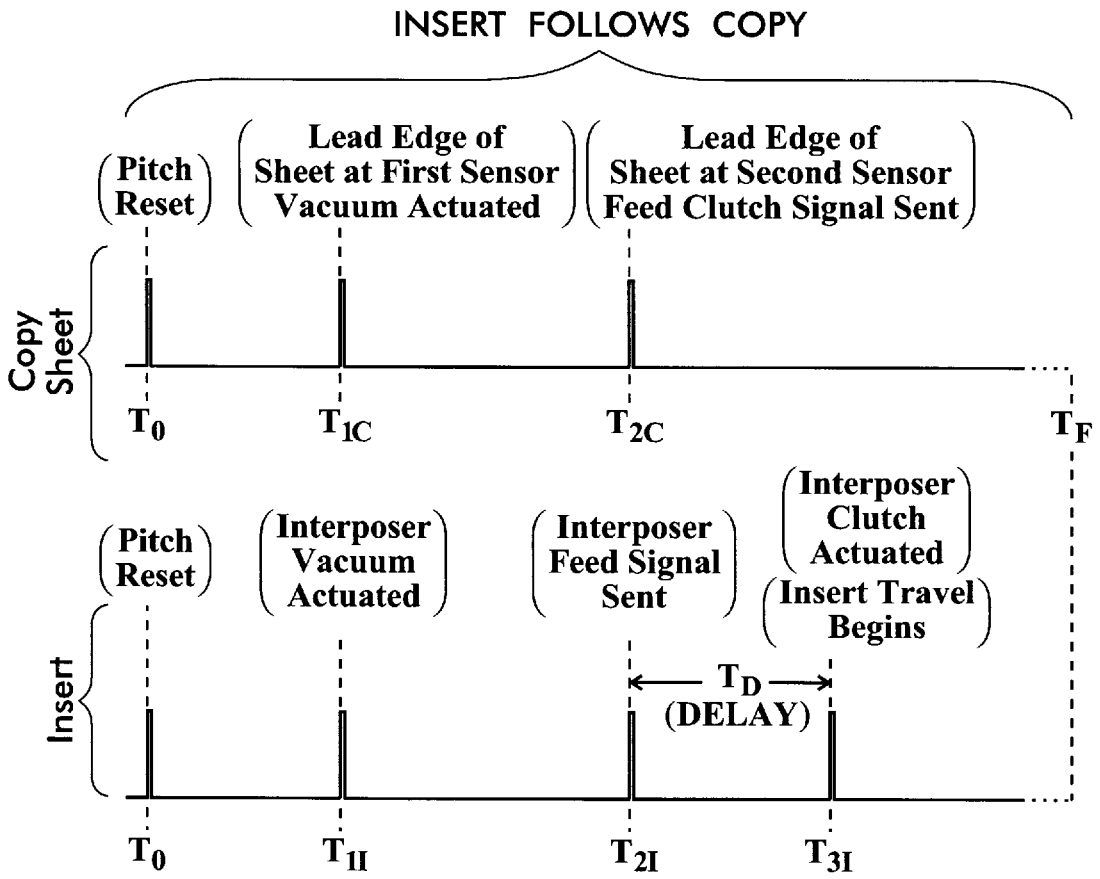
Figure 7:
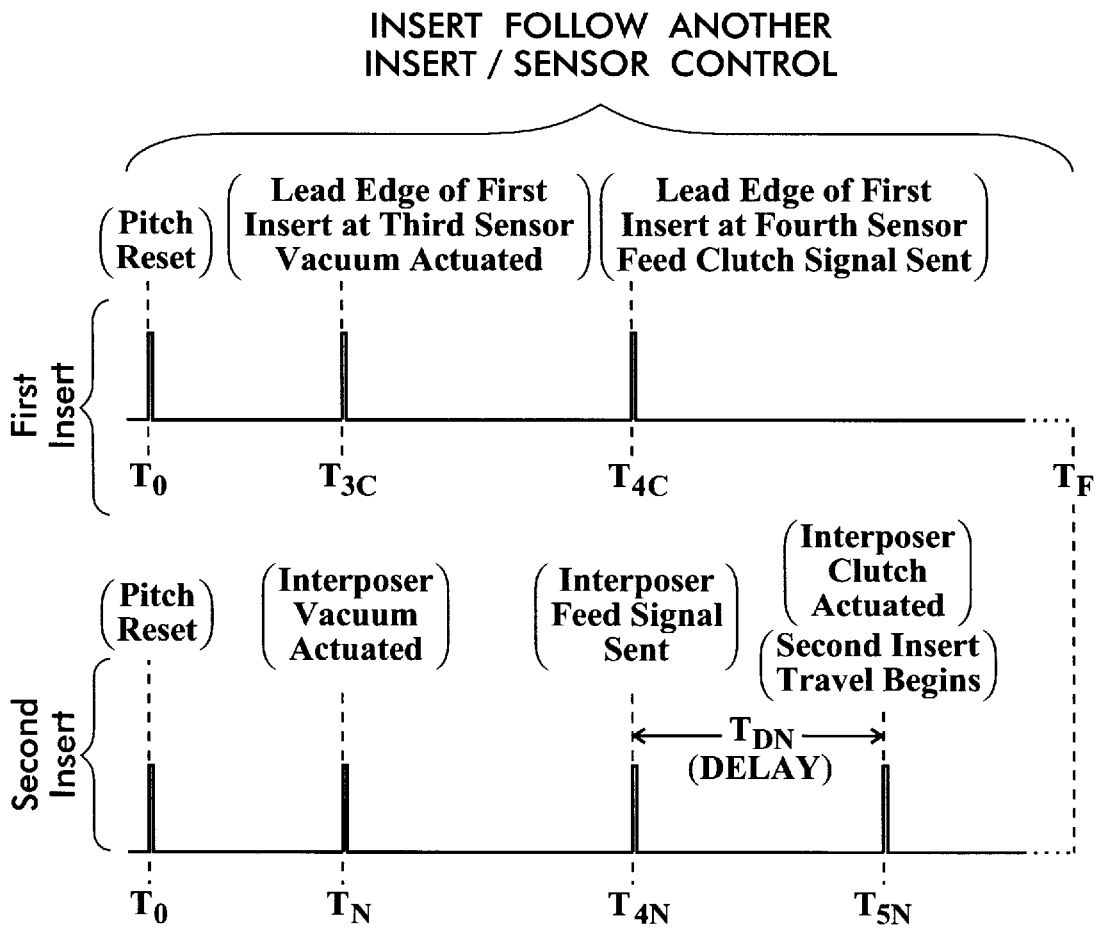

FIG. 4 is a partial schematic view of the paper path and insert path of the printing system of FIG. 1 incorporating the synchronized insert feeder of the present invention; and FIG. 5 is a time plot of the sheet position through the printing system of FIG. 1 incorporating the synchronized insert feeder of the present invention showing the passage of an insert which follows an insert or which is the first sheet of a job;

FIG. 6 is a time plot of the sheet position through the printing system of FIG. 1 incorporating the synchronized insert feeder of the present invention showing the passage of an insert which follows a copy feed through the print engine; and FIG. 7 is a time plot of the sheet position through the printing system of FIG. 1 incorporating the synchronized insert feeder of the present invention showing the passage of an insert which follows an insert, the insert being triggered by a sensor.

It is, therefore, apparent that there has been provided in accordance with the present invention, a modular control assembly that fully satisfies the aims and advantages hereinbefore set forth.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Inasmuch as the art of electrostatographic processing is well known, the various processing stations employed in a typical electrostatographic copying or printing machine of the present invention will initially be described briefly with reference to FIG. 1. It will become apparent from the following discussion that the paper feeding system of the present invention is equally well suited for use in a wide variety of other electrophotographic or electronic printing systems, as for example, ink jet, ionographic, laser based exposure systems, etc.

In FIG. 1, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 6 incorporates a recirculating document handler (RDH) 20 of a generally known type, which may be found, for example, in the well known Xerox Corporation model "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler. As is conventionally practiced, the entire document handler unit 20 may be pivotally mounted to the copier so as to be liftable by an operator for alternative manual document placement and copying. In this manner, the exemplary printing system or apparatus 2 is designed to receive input documents as manually positioned on an optically transparent platen or automatically positioned thereon via a document handler, such as a recirculating document handler (RDH) 20, via a document handler input tray 21 or a document feeder 22.

The RDH 20 operates to automatically transport individual registered and spaced document sheets into an imaging station 23, platen operatively associated with the xerographic processing section 6. A platen transport system 24 is also provided, which may be incrementally driven via a non-slip or vacuum belt system controlled by a system controller 100 for stopping the document at a desired registration (copying) position in a manner taught by various references known in the art.

The RDH 20 has a conventional "racetrack" document loop path configuration, which preferably includes generally known inverting and non-inverting return recirculation paths for transporting original input documents back to the RDH loading and restacking tray 21. An exemplary set of duplex document sheets is shown stacked in this document tray 21. For clarity, the illustrated document and copy sheets are drawn here with exaggerated spacing between the sheets being stacked; in actual operation, these stacked sheets would be directly superposed upon one another. The RDH 20 may be a conventional dual input document handier, having an alternative semiautomatic document handling (SADH) side loading slot 22. Documents may be fed to the same imaging station 23 and transported by the same platen transport system or belt 24 from either the SADH input 22 at one side of the RDH 20, or from the regular RDH input, namely the loading or stacking tray 21, situated on top of the RDH unit. While the side loading slot 22 is referred to herein as the SADH feeding input 22, this input feeder is not limited to semi-automatic or "stream feed" document input feeding, but is also known to be usable for special "job interrupt" insert jobs. Normal RDH document feeding input comes from the bottom of the stack in tray 21 through arcuate, inverting RDH input path 25 to the upstream end of the platen transport 24. Input path 25 preferably includes a known "stack bottom" corrugated feeder-separator belt 26 and air knife 27 system including, document position sensors (not shown), and a set of turn baffles and feed rollers for inverting the incoming original documents prior to imaging.

Document inverting or non-inverting by the RDH 20 is further described, for example, in U.S. Pat. No. 4,794,429 or 4,731,637, among others. Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 40. The RDH return path 40 provides a path for leading the documents back to tray 21 so that a document set can be continually recirculated. This RDH return path 40 includes reversible rollers to provide a choice of two different return paths to the RDH tray 21: a simplex return path 44 which provides sheet or document inversion or a reversible duplex return path 46 which provides no inversion, as will be further explained. For the duplex path 46, the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21, for copying opposite sides of these documents in a subsequent circulation or circulations, as described in the above cited art. Typically, the RDH inverter and inversion path 46, 47 are used only for documents loaded in the RDH input tray 21 and for duplex documents. In normal operation, a duplex document has only one inversion per circulation (occurring in the RDH input path 25). By contrast, in the simplex circulation path there are two inversions per circulation, one in each of the paths 25 and 44, whereby two inversions per circulation is equivalent to no inversion such that simplex documents are returned to tray 21 in their original (face up) orientation via the simplex path 44.

The entire stack of originals in the RDH tray 21 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed into a controller 100, to operator which will be described.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

Output path 88 is directly connected in a conventional manner to a bin sorter 90 as is generally known and as is disclosed in commonly assigned U.S. Pat. No. 3,467,371 incorporated in its entirety by reference herein. Bin sorter 90 includes a vertical bin array 94 which is conventionally gated (not shown) to deflect a selected sheet into a selected bin as the sheet is transported past the bin entrance. An optional gated overflow top stacking or purge tray may also be provided for each bin set. The vertical bin array 94 may also be bypassed by actuation of a gate for directing sheets serially onward to a subsequent finishing station. The resulting sets of prints are then discharged to finisher 8 which may include a stitcher mechanism for stapling print sets together and/or a thermal binder system for adhesively binding the print sets into books. A stacker 98 is also provided for receiving and delivering final print sets to an operator or to an external third party device.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the dual path paper feeder of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device 98. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Figure 2:
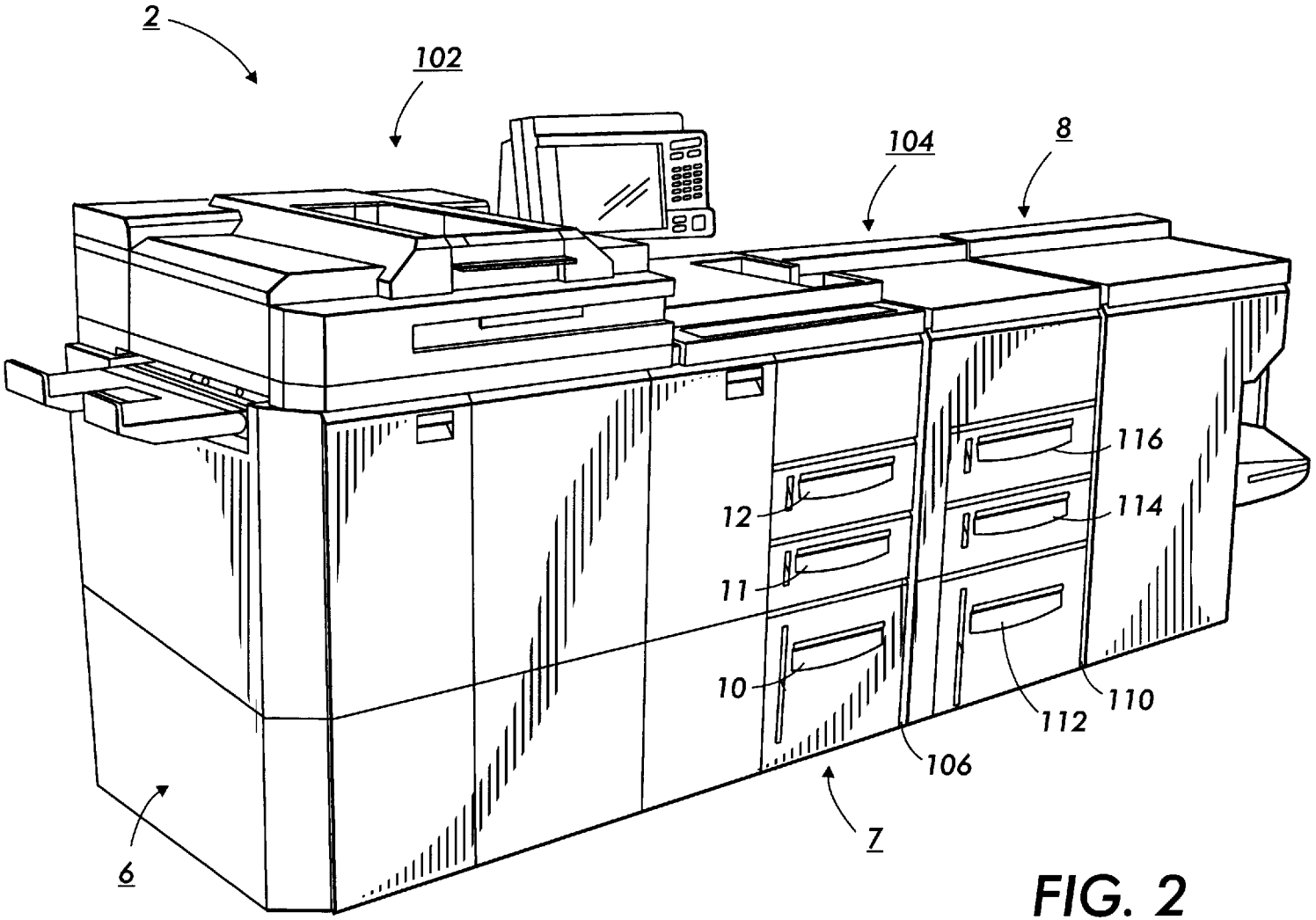
FIG. 2 is a perspective view of the electronic printing system of FIG. 1.

Referring now to FIG. 2, the copy machine 2 includes a printing module 102. The printing module 102 includes print engine 6 as shown in FIG. 1.

Referring again to FIG. 2, the copy machine 2 may include an interposer 104. The interposer 104 provides for additional paper handling capacity. Further, the copy machine 2 may optionally include a finisher 8 for providing finishing operations, e.g. for folding, collating, or stapling, as well as, binding finished copies.

The printing module 102 of the copy machine 2 includes a paper module which includes the paper trays 10, 11 and 12. Similarly, the interposer 104 which includes trays for storing additional paper, typically includes more than one tray, e.g. as shown in FIG. 2, the interposer 104 includes a high capacity interposer tray 112, a secondary interposer tray 114 as well as an auxiliary interposer tray 116. As the copy sheets are processed in the copy machine they will progress from the print module 102 to the interposer 104 crossing first module boundary 106 defined therebetween.

Figure 3:
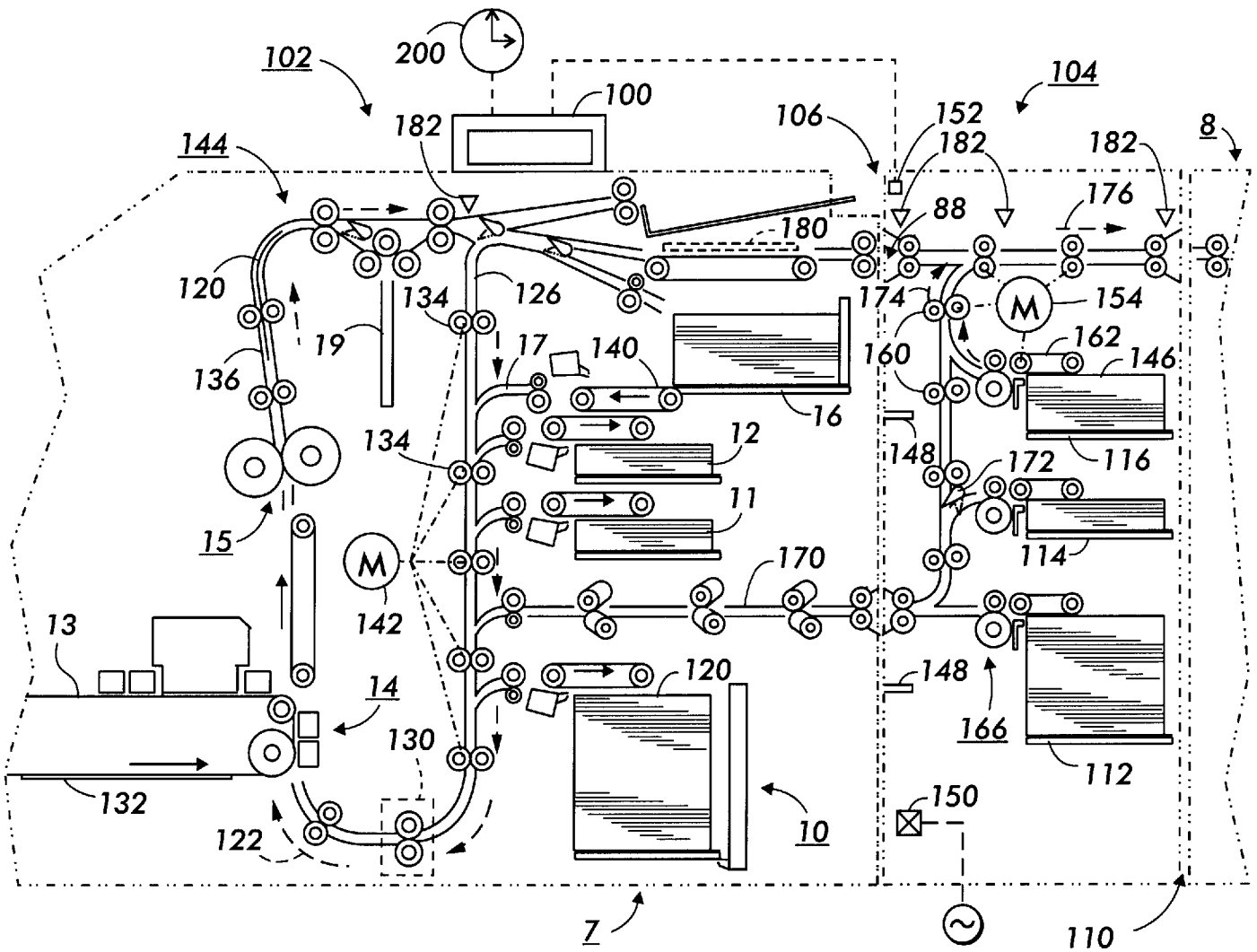
FIG. 3 is a schematic view of the paper path of the printing system of FIG. 1 incorporating the synchronized insert feeder of the present invention depicting the path of a sheet from first sheet position to second sheet position of a printing system.

According to the present invention and referring now to FIG. 3, a copy machine 2 utilizing the synchronized insert feeding across module boundaries of the present invention. The copy machine 2 includes a print module 102 that is separated from interposer module 104 by boundary 106. Sheets 120 are fed through the print engine 6 whereby the blank sheets are converted into copies. The sheets 120 are fed from the sheet feeder section 7 of the print module 102. While as shown in FIG. 3 the copy machine 2 includes three separate trays, trays 10, 11 and 12, it should be appreciated that the sheet feeder section 7 may include a larger or smaller number of trays for containing the sheets 120. The sheets 120 travel from one of the trays 10, 11 or 12 along paper path 122, through transfer station 14 and fuser station 15 toward the boundary 106 separating the interposer 104 from the copy machine 2. The sheets 120 may alternatively, if duplexing or copying both sides of the sheet are necessary, pass through inverter 19 and be returned through return portion 126 of the paper path 122 toward the transfer station 14 to have the opposed side of the duplexed sheet transferred.

As the sheets 120 travel along paper path 122 toward transfer station 14, preferably, the sheets 120 pass by registration station 130 in which the sheets 120 are accurately positioned with respect to developed image 132 formed on photoconductive belt 13. The registration station may have any suitable configuration. For example, the registration station may include TELER registration as described in U.S. Pat. No. 5,337,133, the relative portions thereof incorporated by reference herein. The registration station 130 serves to assure accurate position of the sheet 120 with respect to the developed image 132, thereby providing for accurate placement of the sheets 120.

If a set of copy sheets 120 require duplexing, rather than utilizing the inverter path 124, the sheets 120 may be accumulated in the duplex buffer tray 16 and then returned through return path 126 to the print engine 6 for developing the opposed side.

The sheet 120 may be advanced through the print engine 6 and the sheet feeder section 7 by any suitable method and apparatus. For example, the sheet 120 may be advanced by feed rolls 134 which drive the sheets 120 along baffles 136 directing the sheets 120 along paper path 122. The sheets 120 may be fed from trays 10, 11, 12 and 16 by feed belts 140. To simplify, minimize cause, and to assure synchronization of the feeding of the sheets 120 through the sheet feeder section 7 and print engine 6, preferably, the drive rolls 134 and the drive belts 140 are driven by a common main drive motor 142 mechanically interconnected thereto. The use of a common drive motor 142 assures accurate timing of the sheets through the print engine 6 and the sheet feeder section 7. The main drive motor 142 and the drive rolls 134 and drive belts 140 form a second feed mechanism 144. The main drive motor 142 may include a rotary encoder 143 operably connected to the motor 142.

To provide additional capacity for storing print sheets 120 and to permit the utilization of inserts 146 which preferably do not pass through the print engine 6, the copy machine 2 further includes the interposer 104. The interposer 104 is preferably in the form of a module which may be added to the copy machine 102 and placed between the printer module 102 and the finishing module or section 8 (see FIG. 2).

Referring again to FIG. 3, the interposer preferably is in the form of an independently operating or fairly independent module. Preferably, the interposer 104 is connected mechanically through registrations 148 a power connection 150 and a control connection 152 to connect the interposer 104 to the controller 100. The interposer 104 thus preferably has an interposer drive motor 154 which together with interposer feed rolls 160 and interposer feed belts 162 form a first feed mechanism 166 for advancing sheets 120 and inserts 142 through the interposer 104. The interposer drive motor 154 may include a rotary encoder 155 operably connected to the motor 154.

The sheets 120 within the printer module 102 are controlled by main drive motor 142 while the inserts 146 in the sheets 120 within the interposer 104 are driven by interposer drive motor 154. Coordination of the movement of the sheets 120 and the inserts 146 must be coordinate between the printer module 102 and the interposer 104.

The interposer 104 may include one or more trays for storing sheets 120 and/or inserts 146. As shown in FIG. 3, the interposer 104 includes three trays; the high capacity interposer tray 112 as well as auxiliary trays 114 and 116. The interposer trays 112, 114 and 116 may be designed for storing sheets 120 to be fed to the print engine 6 or to provide storage for inserts 146 to be fed directly to the finisher module or section 8. As shown in FIG. 3, the high capacity feeder 112 is used for storing sheets 120 which are passed into the printer module and progress along engine interposer input path 170 and advanced through print engine 6 to be joined with developed image 132.

As shown in FIG. 3, the lower auxiliary interposer paper tray 114, tray 5, may contain either sheets 120 or inserts 146. When utilizing tray 5 for sheets 120, the sheets 120 are diverted by diverter gate 172 and pass along the print engine interposer input path 170 to the paper path 120 and are developed through the print engine 6. Alternatively, the tray 5 may be used for storing inserts 146. When utilizing the inserts 146, the inserts 146 are diverted by diverter gate 172 along interposer vertical path 174 by feed rolls 160 toward interposer horizontal path 176. The upper auxiliary interposer tray 116, tray 4 as shown in FIG. 3, is utilized for storing inserts 146. The inserts 146 on tray 4 advance upwardly on the vertical path 174 of the interposer and then horizontally along interposer horizontal path 176 toward second boundary 110 of the interposer 104 toward the finisher 8.

For efficient operation of the copy machine 2, the inserts 146 need to be inserted into the stream of sheets 120 being produced through the print engine 6. To perform the efficient inserting of the inserts 146 into the stream of inserts 120 coming from the print engine 6, preferably, a skipped pitch 180 or a pseudo-sheet is utilized. The skipped pitch 180 is like a phantom or non-existing sheet or space in the paper path equal to that of a sheet 120. The skipped pitch 180 represents the position in the stream of sheets 120 in which the insert 146 will eventually be placed.

The timing of the insert 146 within the interposer 176 into the position of the skipped pitch 180 as the skipped pitch 180 enters the interposer path 176 is critical. Placing the insert 146 either early or late will cause paper jams in the interposer path 176 or whatever finishing device, i.e. finishing section 8., is receiving the sheets. The need for consistent sheet spacing is usually most critical in the finishing device. The difficulties in accurately positioning the insert 146 into the position of the skipped pitch 180 is exacerbated by the fact that the sheets 120 may be advancing at speeds of up to 200 cpm and that the insert 146 is driven by motor 154 in the first feed mechanism 166 while the sheets 120 are driven by the main drive motor 142 propelling the second feed mechanism 144.

To permit communication between the machine module 102 and the interposer 104, preferably, the controller 100 is utilized to communicate and coordinate the activities of the printer module 102 and the interposer 104 to accurately time the insertion of the inserts 146 into the stream of sheets 120.

Sensors 182 (see FIG. 3) may be utilized to determine the position of the sheets 120 within the paper path 122 and the inserts 146 within the interposer path 176.

Preferably, a plurality of sensors 182 are utilized with a portion of the sensors 182 within the printer module 102 and a portion within the interposer 104.

Referring now to FIG. 4, and for simplicity, the printer module 102 and the interposer 104 are shown with paper tray 12 and auxiliary tray 116, tray 4, being utilized. It should be appreciated that the utilization of the sensors the timing of the insert 146 into the stream of sheets 120 will be equally applied for other insert trays and sheet trays.

The sensors 182 serve to indicate when a sheet 120 is at a certain point in the paper path 122 such that it is time for the insert 146 to begin its travel along inverter path 176 to match up with the skipped pitch 180 provided for the location of the insert 146. As shown in FIG. 4, the insert 146 within tray 116 is removed therefrom by feed belt 162. Feed belt 162 is energized and deenergized by any suitable manner, i.e. as shown in FIG. 4, the feed belt 162 is driven by feed clutch 186 which energized and deenergized the feed belt 162 advancing the insert 146 into the interposer path 176 where the feed rolls 160 advance the insert 146 thereallong.

Further, to engage the insert 146 with the feed belt 162, a vacuum source 190 is utilized to urge the insert 146 against feed belt 162. The vacuum source 190 likewise must be energized or actuated to cause the insert 146 to begin its path along the interposer path 176.

Preferably, therefore, the sensors 182 include a first sensor 192 located in the path 122. It should be appreciated that the position of the first sensor 192 may be anywhere along the paper path 122 and should be so positioned such that passing of the sheet 120 past the paper path 122 is at a point in time sequentially such that the insert 146 were to begin its paper path along the interposer path 176 it would match up with a skipped pitch 180. The first sensor 192 sends a signal to the controller 100 which indicates that the vacuum source 190 should be energized. The controller 100 sends a signal to the vacuum source 190 to energize the vacuum source and thus to advance the insert 146 toward the feed belt 160. Further downstream along the feed path 122 is located a second sensor in the form of an upper entrance sensor 194.

The upper entrance sensor 194 is positioned anywhere along the paper path 122 such that the sheet 120 may arrive at the upper entrance sensor at a time in which if the second sensor 194 is tripped the feed clutch 186 may begin the motion of the insert 146 along interposer path 176 such that the insert 146 trails immediately behind the sheet 120. As shown in FIG. 4, the second sensor or upper entrance sensor 194 is positioned along boundary 106 between the machine module 102 and the interposer module 104.

When the leading edge of sheet 120 approaches the upper entrance sensor 194, the sensor 194 sends a signal to the controller 120 indicating the position of the sheet 120. The controller 100 then sends a signal to feed clutch 186 to actuate the feed clutch 186 such that feed belt 162 advances the insert 146 toward the feed rolls 160 to pass the insert 186 along interposer path 176.

Alternatively, to assure that a insert 146 is properly positioned between the sheets 120 to form the set of sheets, the copy machine 2 may further include additional sensors 182 downstream of the insertion of the insert 146 into the stream of sheets 120. For example, the interposer 104 may include a third sensor, i.e. upper transport sensor 196 positioned after the insert 146 arrives in the paper path 122. Further, the interposer module 104 may also include a fourth sensor, i.e. nip release sensor 198 positioned at exit boundary 110 of the interposer. The sensors 196 and 198 serve to measure the distance between adjacent sheets and inserts such that the spacing between adjacent inserts and sheets may be equal and have a distance, i.e. S between adjacent sheets. If the space between the insert 146 and the sheet 120 immediately preceding it is less than a desired distance, the controller 100 may include a clock 200 which will be utilized with a delay to delay the signal from the turn on feed clutch signal of the second sensor 194 such that the feed clutch 186 is delayed a distance equal to the clock time within the controller 100 thus delaying the insert 146 will increase the distance between the insert 146 and its adjacent preceding sheet 120. Thus, a feedback loop may be provided with the third sensor 196 and the fourth sensor 198 to optimize and control the distance S.

Booklets or sets of sheets may include inserts 146 and sheets 120 in any desired arrangement. For example, a multitude of sheets 120 may be positioned between cover inserts 146 on each side thereof. Further, the booklet or set of sheets may include a insert 146 positioned in the middle of a set of sheets 120 or any desired variation thereof. When utilizing these various configurations of booklets, a situation may arise where one of at least three scenarios may occur. The first of these is that an insert 146 immediately follows a sheet 120. A second alternative may be that an insert 146 follows a preceding insert 146. A third configuration may be that the first sheet in a set of sheets is an insert 146. Each of these three configurations requires special adaptation to make the insertion across module boundaries with the use of sensors work properly.

Consider first the insertion of an insert 146 immediately after a sheet 120. With this scenario the sheet 120 passes first by first sensor 192 at which time the sensor 192 sends a signal to the controller 100 and the controller 100 sends a signal to the vacuum source 190 to actuate the vacuum to have the insert 146 be attracted to the feed belt 162.

When the lead edge 202 of the sheet 120 approaches the upper entrance sensor 194, the upper entrance sensor 194 sends a signal to the controller 100 which in turn sends a signal to the feed clutch 186 to actuate the clutch 186. The clutch 186 actuates the feed belt 162 to pass the insert to the feed roll 160 within the interposer path 176. The insert 146 and the sheet 120 progress into the paper path 120 within the interposer module 104 with the insert 146 trailing a distance S behind the sheet 102.

Referring now to FIG. 6, the first scenario is depicted as a graph of the position of the copy sheet 120 and the insert 146 with respect to time. The xerographic process begins at a position $T_0$ at which the pitch is reset at a time $T_{1C}$ the lead edge 202 of the copy sheet 120 passes by first sensor 192 at time $T=T_{1C}$. At time $T=T_{1I}$ the vacuum source 190 brings the insert 146 into contact with the feed belt 162. At time $T=T_{2C}$ the lead edge 202 of the sheet 120 passes by the second sensor 194 at time $T_{2C}$. At time $T_{2C}$ the second sensor 194 sends a signal to the controller 100. At time $T_{2I}$, or after a delay $T_{DC}$ from clock 200, i.e. at time $T_{3I}$, the clutch 186 is released causing the insert 146 to advance along the interposer path 176.

Referring now to FIGS. 4 and 5 the second and third scenario occur when the insert is the first sheet or follows a skipped pitch. For example, as shown in FIG. 4 second insert 204 follows insert 146 in this scenario. To accomplish this a second skipped pitch 206 must follow skipped pitch 180 within the machine module 102. As is obvious from FIG. 4 the skipped pitch 180 being a pseudo sheet will not trigger the first and second sensors 192 and 194 respectively to activate the vacuum source 190 and 162, respectively to accomplish the sequencing as earlier described for the first case.

The solution for this case utilizing the pseudo-sheet may be typically shown and described referring now to FIG. 5. FIG. 5 shows a time graph of the position of the insert and the skip pitch or pseudo sheet 180.

The controller 100 records the motion of the sheets 120 as they pass by the first and second sensors 194 and 196. The time required for the sheet 120 to arrive at the first and second sensors 192 and 194 from the pitch reset time is plotted for a number of sheets 120. The average time from pitch reset to the lead edge 202 of the sheets 120 arriving at first sensor 192 is found and can be shown as $T_{1A}$ of FIG. 5. Similarly, the time from pitch reset to the lead edge 202 of the sheets 120 arriving at second insert 194 can be plotted and the average $T_{2A}$ can be determined showing an average time from pitch reset to the lead edge being at the second sensor. Pseudo sheets giving pseudo sheet signals can thus be determined based upon the average time $T_{1A}$ and $T_{2A}$. While the skipped pitches 180 and 206 will not trip a signal at the first and second sensors 194 and 196, the skipped pitches 180 and 206 will have corresponding pitch reset signals. Therefore, skipped pitch 180 will have a pitch reset and a time can be determined from that pitch reset to when that pseudo sheet or skipped pitch 180 will arrive with its lead edge at the first sensor. That time is equal to an average of such times for sheets 120 as shown above in FIG. 5.

Where no historical data is available, i.e. when the machine is first installed or when the insert is the first sheet of a new job, stored default values may be stored in the controller 100 which can be used to create the pseudo sheets. Because in this case the insert is not preceded by another sheet, the need for timing accuracy is not as critical as the other cases, where the insert must be equidistant from both the preceding and following sheet.

Pitch reset represents a time in the xerographic process that initiates the process. Pitch reset begins before the photoreceptor belt 13 is exposed at imaging station 236, see FIG. 1.

As skipped pitch 180 approaches the first sensor 192 a time $T_{1P}$ has elapsed since time $T_0$ when the skipped pitch 180 was initiated at pitch reset. Therefore, at time $T_{1IP}$ corresponding to time $T_{1P}$, the vacuum source 190 is actuated to advance the insert 204 against feed belt 162. As the skipped pitch 180 advances toward the lead edge of skipped pitch 180 in alignment with the second sensor 194, the skipped pitch 180 or pseudo sheet has progressed from a time $T_0$ of pitch reset of the skipped pitch 180 to a time $T_{2P}$ equal to an average of the time for sheets 120 to approach second sensor 194. At the time $T_{2IP}$, corresponding to time $T_{2P}$, or as shown after a delay $T_{DP}$, at the time corresponding to time $T_{3IP}$, the clutch 186 is released to advance the feed belt 162 against insert 204 advancing the insert 204 into the interposer path 176. The second insert 204 is thus positioned behind the first insert 146 a distance S as shown in FIG. 4. The approach as shown in FIG. 5 can be utilized when the insert is the first sheet of a set of sheets provided the information from earlier sets of sheets 120 may be utilized to determine the time $T_{1P}$ and time $T_{2P}$ for the pseudo sheet or where an insert follows a previous insert.

As an alternative, the second scenario of feeding of an insert followed by an insert may be accomplished rather than by pseudo sheets by the use of additional sensors. For example, referring to FIG. 4, additional inserts, i.e. upper transport sensor 196 and nip release sensor 198 may be so positioned such that upper transport sensor 196 may be utilized to turn on the vacuum source 190 for the second or following insert and the nip release sensor 198 may be utilized to turn on the feed clutch 186 to advance the second insert 204.

Referring now to FIG. 7, the time plot of inserting a insert followed by a second insert utilizing additional sensors is shown. The first insert 146 passes by third sensor 196 at time $T_{3C}$. At first insert time $T_{3C}$, the vacuum source 190 is actuated at second insert time $T_{3N}$. Subsequently, at first insert time $T_{4C}$, the lead edge of the first insert 146 passes by fourth sensor 198. At second insert time $T_{4N}$ corresponding to first insert time $T_{4C}$, or as shown in FIG. 7, after a delay of $T_{DN}$, the feed clutch 186 is released causing the second insert 204 to advance toward the interposer path 176 at second insert time $T_{5N}$.

It should be appreciated that the alternative approach of synchronizing an insert after an insert as shown in FIG. 7 is perhaps more accurate but requires additional sensors. The appropriate approach of either FIG. 5 or FIG. 7 should be dependent upon the cost and accuracy required for the system.

By providing synchronized insert feeding across module boundaries with pseudo sheets, accurate positioning of inserts may be accomplished.

By providing synchronized feeding of inserts across module boundaries utilizing pseudo sheets where components may be accounted for.

By providing synchronized feeding of inserts across module boundaries utilizing pseudo sheets variations and voltages of motors and components may be accounted for.

By providing synchronized insert feeding across module boundaries utilizing the signals from the prior sheet, the irregularities of inverting and compiling sheets may be accounted for accurately.

By providing for inserting sheets across module boundaries utilizing sensors to measure the position of sheets variations in time and travel of the sheets and inserts within the modules may be considered.

By providing for insert feeding across module boundaries utilizing additional sensors to determined the actual position of the inserts and sheets a feed back loop may be included to optimize and accurately position adjacent sheets.

By utilizing a process for inserting sheets in a string of sheets across module boundaries utilizing pseudo sheets the use of an extremely large number of sensors in the paper path and complex feed back loops may be avoided.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A method for synchronizing the feeding of a trailing insert by a first feed mechanism immediately subsequent to the feeding of a leading insert by the first feed mechanism into a stream of substantially equally spaced traversing sheets at a insertion location, the stream of sheets feed from a second feed mechanism, the method comprising:

placing one of said sheets in operable contact with the second feed mechanism at a sheet feed initiation position at a latent image time related to the transfer of the latent image to the sheet;

traversing the sheet sequentially with the second feed mechanism and the first feed mechanism;

advancing the sheet toward a sheet sense position in cooperation with a first sensor adjacent one of the first feed mechanism and the second feed mechanism;

releasing the first insert from an insert release means at a release time based on the time required for the sheet to travel from the first sensor to an insertion location and the time required for the first insert to travel from an insert release position to the insertion location so that the first insert arrives at the insertion location immediately subsequent to the sheet;

calculating a release time for the first insert relative to the latent image time; and releasing a second insert based on the release time of the first insert relative to the latent image time in order that the second insert arrives at the insertion location immediately subsequent to the first insert.

2. The method of claim 1 further comprising the steps of:

determining the distance the sheet must travel from the first sensor to the insertion location;

calculating the time required for the sheet to travel from the first sensor to the insertion location based on the distance the sheet must travel from the first sensor to the insertion location and the speed of the second feed mechanism;

determining the distance the first insert must travel from an insert release position to the insertion location; and calculating the time required for the first insert to travel from the insert release position to the insertion location based on the distance the first insert must travel from the insert release position to the insertion location and the speed of the first feed mechanism.

3. The method of claim 1, wherein the step of advancing the sheet comprises advancing the sheet toward the sheet sense position in cooperation with the first sensor adjacent the first feed mechanism.

4. The method of claim 1, wherein the step of releasing the first insert comprises:

connecting a clutch to a motor driving the first feed mechanism between the motor and the first feed mechanism;

disengaging the clutch;

placing the first insert in contact the first feed mechanism;

placing the sheet in cooperation with the sensor;

delaying engagement of the clutch; and engaging the clutch.

5. The method of claim 1 further comprising the steps of:

determining a desired delay of the first insert behind the sheet as the sheet and the first insert travel in the first feed mechanism after the insertion location;

placing a second sensor into cooperation with the sheet and the first insert as the sheet and the first insert travel past a feedback position downstream form the insertion location;

measuring an actual delay of the insert behind the sheet as the sheet and the first insert travel in the first feed mechanism past the insertion location;

comparing the actual delay to the desired delay to determine a delay error; and adjusting the timing of placing the second insert in operable contact with the first feed mechanism at the insert release position in response to the delay error to minimize the delay error between the first insert and the second insert.

6. A printing apparatus for synchronizing the feeding of a trailing insert by a first feed mechanism immediately subsequent to the feeding of a leading insert by said first feed mechanism into a stream of substantially equally spaced traversing sheets at a insertion location, the stream feed by a second feed mechanism, said printing apparatus comprising:

a first feed mechanism operably associated with the printing apparatus for translating the leading insert and the trailing insert, said first feed mechanism defining a insert release position;

a second feed mechanism operably associated with the printing apparatus for traversing a sheet at a sheet feed initiation position at a latent image time related to the transfer of the latent image to the sheet, said second feed mechanism urging the sheet toward said first feed mechanism, said first feed mechanism adapted to translate the sheet from said second feed mechanism;

engaging means connected to said first feed mechanism for engaging and disengaging said first feed mechanism from the insert;

a first sensor operably associated with the printing apparatus and positioned at a first sensor location adjacent one of said first feed mechanism and said second feed mechanism for determining when the sheet approaches the first sensor location;

a controller operably associated with the first sensor and said engaging means for receiving input from the sensor, for sending a signal to said engaging means to release a trailing insert based on the release time of the leading insert relative to a pitch reset time in order that the trailing insert arrives at the insertion location immediately subsequent to the leading insert and sending a signal to said engaging means to release said engaging means at such a point in time relative the passing of the sheet pass the sensor such that the sheet and the insert arrive sequentially at the insertion location; and a second sensor positioned downstream from said first sensor at second sensor location, downstream from the insertion location, and adjacent said first feed mechanism, said second sensor adapted to send a sheet arrival signal to said controller indicative of the arrival of the sheet adjacent said second sensor and adapted to send a insert arrival signal to said controller indicative of the arrival of the leading insert adjacent said second sensor, wherein said controller is adapted to determine a desired delay of the insert behind the sheet as the sheet and the insert travel in said first feed mechanism past the fifth position, is adapted to receive the sheet arrival signal and the insert arrival signal from said second sensor, is adapted to calculate an actual delay, is adapted to compare the actual delay to the desired delay so as to determine a delay error; and is adapted to adjust the timing of placing a subsequent insert in operable contact with said first feed mechanism at the third position subsequent to a subsequent sheet being in cooperation with said first sensor in response to the delay error to minimize the delay error between the subsequent insert and the subsequent sheet.

* * * * *